US007022046B2

(12) United States Patent
Kim

(10) Patent No.: US 7,022,046 B2
(45) Date of Patent: Apr. 4, 2006

(54) EXERCISE DEVICE AND METHOD

(76) Inventor: C. Eli Kim, 201 Hickory Ct., Lansdale, PA (US) 19446

( * ) Notice: Subject to any disclaimer, the term of this patent is extended or adjusted under 35 U.S.C. 154(b) by 639 days.

(21) Appl. No.: 10/043,796

(22) Filed: Jan. 14, 2002

(65) Prior Publication Data

US 2003/0134725 A1 Jul. 17, 2003

(51) Int. Cl.
*A63B 21/00* (2006.01)

(52) U.S. Cl. ..... 482/1; 482/92; 482/126

(58) Field of Classification Search ..... 482/1, 482/3, 8, 92, 121, 122, 93, 110, 114, 126
See application file for complete search history.

(56) References Cited

U.S. PATENT DOCUMENTS 4,557,479 A * 12/1985 Guibert ..... 482/110
4,973,043 A 11/1990 Nolan
5,022,648 A * 6/1991 Travis ..... 482/126
5,300,002 A * 4/1994 Freye ..... 482/114
5,393,284 A 2/1995 Wesley ..... 482/106
5,820,531 A * 10/1998 Choi ..... 482/93
5,871,423 A 2/1999 Pruchnik ..... 482/110
5,904,640 A * 5/1999 Shahinian ..... 482/110
6,752,747 B1 * 6/2004 Yu ..... 482/110

* cited by examiner

*Primary Examiner*—Glenn E. Richman
(74) *Attorney, Agent, or Firm*—Lamorte & Associates

(57) ABSTRACT

A device for exercising and the associated method of using the device to exercise. The exercise device has a first handheld element on which is located a first surface. A second handheld element is also provided. A second opposing surface is located on the second handheld element. The first surface on the first handheld element can be aligned with the second opposing surface on the second handheld element when both the first handheld element and the second handheld element are positioned in a predetermined orientation. A biasing mechanism is provided between the first handheld element and the second handheld element. The biasing mechanism applies a force that opposes the positioning of the first handheld element and the second handheld element into the predetermined orientation.

14 Claims, 4 Drawing Sheets

EXERCISE DEVICE AND METHOD

BACKGROUND OF THE INVENTION

1. Field of the Invention

The present invention relates to exercise devices and methods of using exercise devices to perform exercise. More particularly, the present invention relates to exercise devices and methods that utilize specially configured exercise bars or similar structures.

2. Prior Art Statement

The prior art of exercise equipment contains many different types of exercise bars and similar structures. Exercise bars seem to serve three different purposes. The first type of exercise bar is used to support weights so that a person can readily lift the weights. As such, the exercise bar does little more than act as the bar to a barbell. Such prior art exercise bars are exemplified by U.S. Pat. No. 3,588,102 to Gifford, entitled Exercise Bar.

A second type of exercise bar is a bar that is used to help a person stretch their body. Such exercise bars do not support added weight, but merely help a person retain both their balance and form as they stretch. Such prior art exercise bars are exemplified by U.S. Pat. No. 5,029,847 to Ross, entitled Foldable Exercise Bar and U.S. Pat. No. 6,129,650 to Wedge, entitled Exercise Bar.

A third type of exercise bar is a bar that actively provides resistance to movement. With such exercise bars, the exercise bar must be deformed from a set configuration. The deformation of the exercise bar provides the resistance for the exercise being performed. Such prior art exercise bars are exemplified by U.S. Pat. No. 5,393,284 to Wesley, entitled Flexible Barbell Exercise Apparatus and U.S. Pat. No. 4,973,043 to Nolan, entitled Exercise Device.

The present invention provides an exercise bar of a type not previously used in the art. The present invention exercise device provides an exercise bar that is unstable when oriented as a bar. Exercise is achieved by a person trying to maintain the exercise bar in its unstable configuration. This utility and method are described and claimed below.

SUMMARY OF THE INVENTION

The present invention is a device for exercising and the associated method of using the device to exercise. The exercise device has a first handheld element on which is located a first contact surface. A second handheld element is also provided. A second contact surface is located on the second handheld element. The first contact surface on the first handheld element can be aligned with the second contact surface on the second handheld element when both the first handheld element and the second handheld element are positioned in a predetermined orientation.

A biasing mechanism is provided between the first handheld element and the second handheld element. The biasing mechanism applies a force that opposes the positioning of the first handheld element and the second handheld element into the predetermined orientation. Exercise is achieved when the first handheld element and the second handheld element are manually manipulated into the predetermined orientation against the opposing bias of the bias mechanism.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Figure 1:
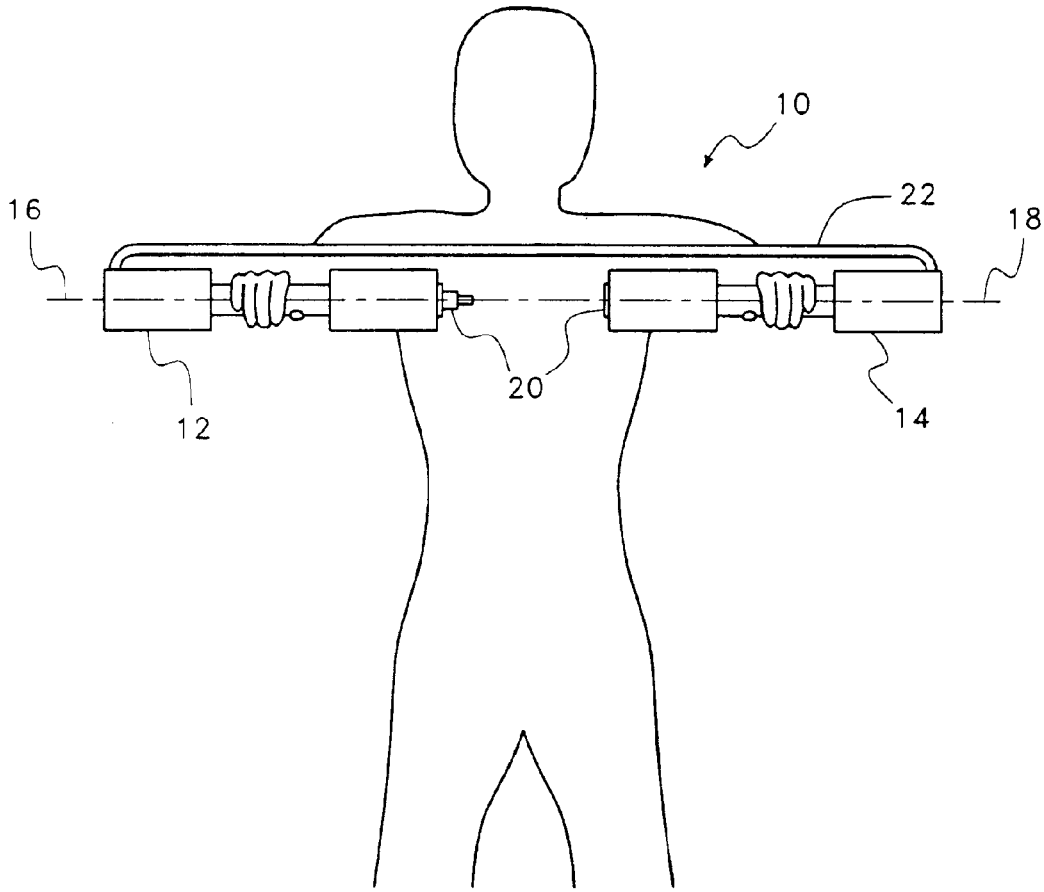
FIG. 1 is a front view of an exercise device in accordance with the present invention being held by a person.

Referring to FIG. 1, an exemplary embodiment of the present invention exercise device 10 is shown. The exercise device 10 includes two separate handheld elements 12, 14. Each of the handheld elements 12, 14 has a longitudinal axis 16, 18, wherein each of the handheld elements 12, 14 are symmetrically formed about its longitudinal axis. Disposed between the two handheld elements 12, 14 is an alignment mechanism 20. As will be later explained, the alignment mechanism 20 provides an indication of when the longitudinal axes of the two handheld elements are linearly aligned. Also disposed between the two handheld elements 12, 14 is a biasing mechanism 22 that acts to oppose the linear alignment of the two handheld elements 12, 14. As such, to align the two handheld elements 12, 14 of the device 10, the two handheld elements 12, 14 must be manipulated against the force of the biasing mechanism 22. It is this controlled manipulation of force that tones muscle and provides exercise.

Figure 2:
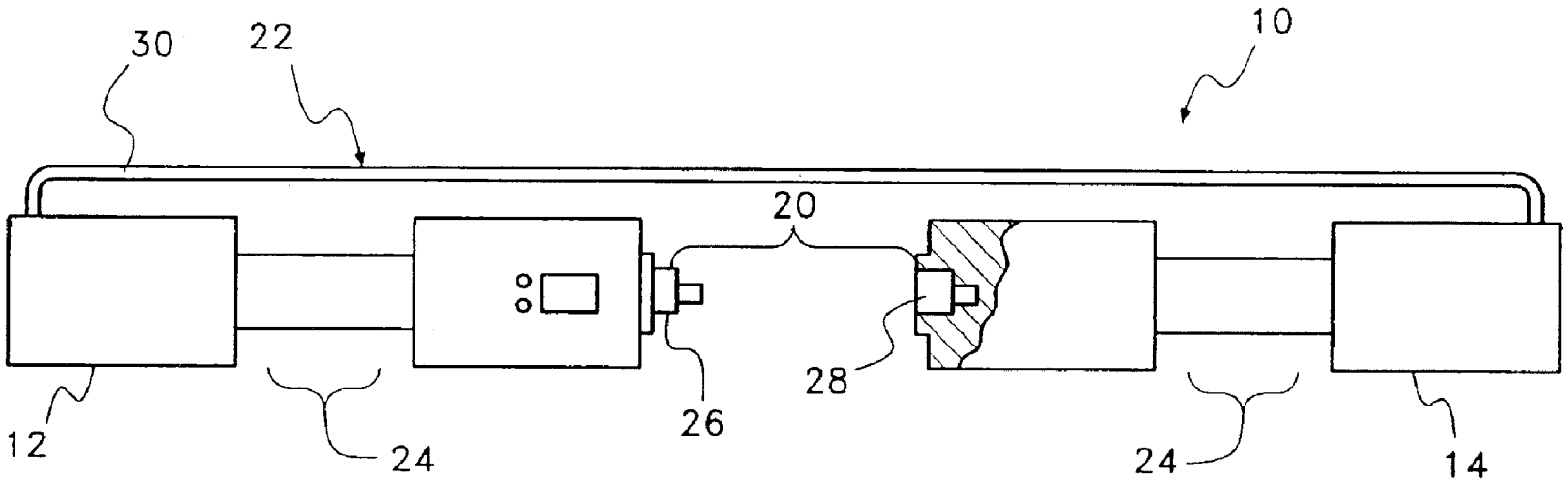
FIG. 2 is an enlarged view of the embodiment of the exercise device shown in FIG. 1.

Referring now to FIG. 2, it can be seen that each handheld element 12, 14 of the device 10 is a weighted structure that weighs between two pounds and twenty-five pounds. Each handheld element 12, 14 is symmetrically formed along is linear central axis, 16, 18. In the shown embodiment, each handheld element 12, 14 has a slight barbell configuration, wherein each handheld element 12, 14 is held in a narrow central handle region 24. However, such a configuration is merely exemplary and other shapes can be used, as will later be illustrated.

In the shown embodiment of FIG. 2, the alignment mechanism 20 used is mechanical and includes a peg and hole configuration. An externally stepped male protrusion 26 extends from one end of one of the handheld elements 12. An internally stepped annular female relief 28 is formed in one end of the other handheld element 14. When the male protrusion 26 from the first handheld element 12 is squarely inserted into the female relief 28 of the second handheld element 14, the two handheld elements 12, 14 are linearly aligned. However, if one or the other handheld element 12, 14 is tilted, the male protrusion 26 will touch the side of the female relief 28 in a manner that is easily seen and felt.

In the shown embodiment, the surfaces of both the male protrusion 26 and the female relief 28 can be magnetized with repelling polarities. In this manner, the magnetic repulsion between the male protrusion 26 and the female relief 28 provides a biasing force that opposes the flush interconnection of the male protrusion 26 within the female relief 28.

Since both handheld elements 12, 14 of the device 10 are weighted, it takes strength to hold the two handheld elements in linear alignment with outstretched arms. The effort to hold the two handheld elements 12, 14 in alignment is complicated by both the presence of the biasing mechanism 22 and the magnetic repulsion between the male protrusion 26 and the female relief 28.

The biasing mechanism 22 in the shown embodiment is an elastic cord 30. The elastic cord 30 is attached to the far ends of the handheld elements 12, 14, opposite the ends that are to be aligned. The length of the elastic cord 30 is shorter than the combined length of the two handheld elements 12, 14. Accordingly, when the two handheld elements 12, 14 are linearly aligned end-to-end, the elastic cord 30 becomes stretched. The stretched elastic cord 30 extends down one side of the linearly aligned handheld elements 12, 14. As such, the elastic cord 30 applies a bending torque to the far ends of the handheld elements 12, 14 that acts to pull the two handheld elements 12, 14 out of linear alignment. The amount of bending torque is dependent upon the length of the elastic cord 30 and the spring constant rating of the elastic cord 30.

The purpose of the elastic cord is to apply a tension force to the far ends of the two handheld elements 12, 14. As such, it should be understood that the illustrated elastic cord 30 can be replaced with a long metal spring or an elastic band. Both elements would work in the same manner as the described elastic cord 30.

To exercise with the present invention device 10, each handheld element 12, 14 is grasped by a hand of a user. With outstretched arms, a user then attempts to linearly align the two handheld elements 12, 14 of the device 10 and maintain that linear alignment for a predetermined period of time. Proper linear alignment can be ascertained by the use of the alignment mechanism 20 between the two handheld elements 12, 14. Resistance to the linear alignment is provided by the weight of the two handheld elements 12, 14, the magnetic repulsion between the male protrusion 26 and the female relief, and the biasing mechanism 22 that all acts to bias the two handheld elements 12, 14 away from a linear orientation. The effort of a user to hold the two handheld elements 12, 14 in a linear orientation requires the use of several muscle groups in the arms and chest. Furthermore, the exercise requires extreme mental focus and muscle control. The result is an exercise that helps develop muscles in the arms and chest and also helps a person's ability to concentrate and develop controlled muscle coordination.

As has been previously stated, exercise is performed when a person attempts to hold the two handheld elements 12, 14 in a linear orientation for a predetermined period of time. To assist in this endeavor, an optional timer 29 may be placed on one or both of the handheld elements. The timer is positioned and sized so that it can be viewed by a person holding the two handheld elements 12, 14 at an arm's length. The timer 29 displays the passage of time and can be preprogrammed with different time periods for different types of exercises.

In FIG. 2, a peg and hole configuration was used as a mechanical alignment mechanism 20 to enable a person to determine when the two handheld elements 12, 14 of the device 10 are held in linear alignment. Such an alignment mechanism is merely exemplary and many other mechanisms can be used for the same purpose. For example, both ends of the handheld elements 12, 14 can be formed with flat ends. Linear alignment between the two handheld elements 12, 14 can be obtained when the two flat ends are held flush against each other.

Figure 3:
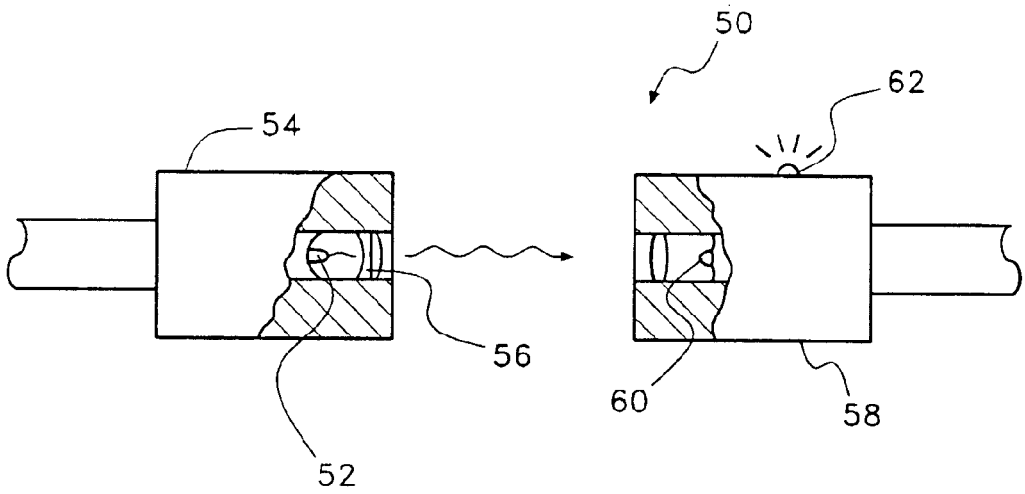
FIG. 3 is a fragmented and selectively cross-sectioned view of an alternate embodiment of the present invention exercise device.

Referring to FIG. 3, an alternate embodiment of the present invention exercise device 50 is shown. In this embodiment, a light source 52 is provided in one handheld element 54 of the exercise device 50. The light source 52 transmits a beam of light out of the end of the handheld element 54. The beam of light can be in the infrared or visible light spectrums. Optical elements 56 may be provided in front of the light source 52 to focus or collimate the beam of light. The second handheld element 58 contains an optical detector 60 that detects the beam of light emitted by the light source 52. The optical detector 60 only detects the beam of light when the beam of light is linearly aligned with the optical detector 60. Accordingly, in order for the optical detector 60 to detect the beam of light, the two handheld elements 54, 58 of the exercise device 50 must be linearly and concentrically aligned.

The optical detector 60 can be coupled to either an audio or visual indicator 62. When the two handheld elements 54, 58 of the exercise device 50 are aligned and the optical detector 60 detects the beam of light, the indicator 62 is activated. By either hearing and/or observing the indicator 62, a person can determine whether or not the two handheld elements 54, 56 of the exercise device 50 are aligned.

It will therefore be understood that many different alignment mechanisms can be adapted for use with the present invention. In each usable alignment mechanism, there is some mechanism that can provide a visual and/or audible indication of linear alignment. Such mechanisms can include mating mechanical devices, such as in FIG. 1, and optical devices, such as are shown in FIG. 3. Other alignment mechanisms can include reed switches and magnets, electrical couplings, contact switches and the like.

Figure 4:
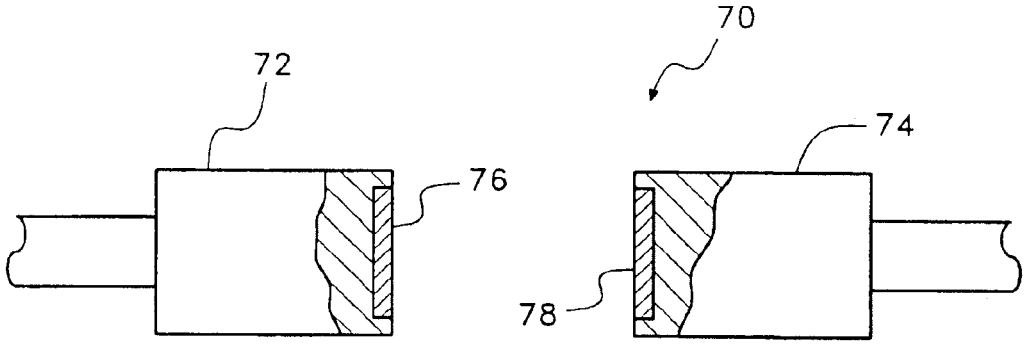
FIG. 4 is a fragmented and selectively cross-sectioned view of an alternate embodiment of the present invention exercise device.

Furthermore, in FIG. 1, an elastic cord is used as the biasing element. Such a selection is merely exemplary and it should be understood that other devices can be used. Referring to FIG. 4, one such alternate device 70 is shown. In this embodiment, both handheld elements 72, 74 of the exercise device 70 are provided with flat magnets 76, 78. The flat magnets 76, 78 are oriented with common poles facing outward. As such, when the ends of the two handheld elements 72, 74 are brought together, the common pole of the two sets of magnets 76, 78 are brought into close proximity. Since both sets of the magnets 76, 78 are of the same pole, the magnets 76, 78 repel reach other. The repelling force of the magnets 76, 78 biases the two handheld elements 72, 74 of the device 70 out of linear alignment. Accordingly, to align the two handheld elements 72, 74 of the device 70, the two handheld elements 72, 74 of the device 70 must be pushed together against the repulsive force of the magnets 76, 78. As such, the magnets 76, 78 act as a biasing mechanism that biases the two handheld elements 72, 74 of the device 70 out of linear alignment. The strength of the repulsive force is directly proportional to the strength of the magnets 76, 78. In the preferred embodiment, rare earth magnets 76, 78 are used in that rare earth magnets provides a stronger magnetic field than do most ferrite base magnets.

Figure 5:
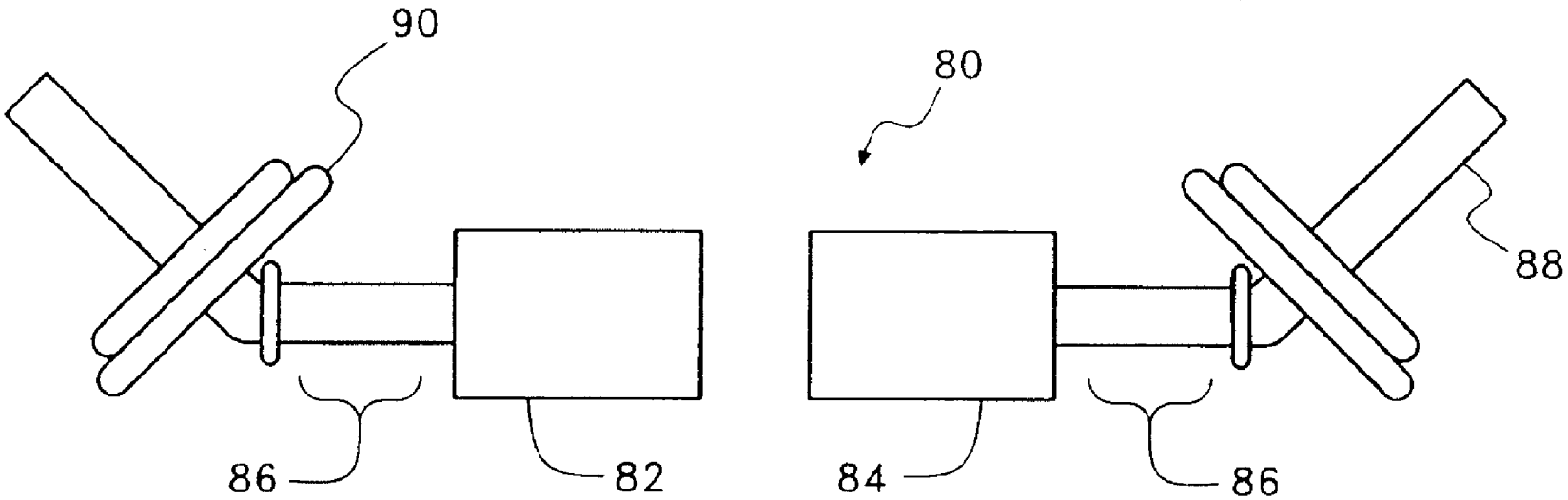
FIG. 5 is a front view of an alternate embodiment of the present invention exercise device.

Referring to FIG. 5, yet another alternate embodiment of the present invention exercise device 80 is shown. In this embodiment 80, each of the handheld elements 82, 84 has a handle section 86, where they are grasped. Furthermore, each of the handheld elements 82, 84 has a section 88 that accepts free weights 90. By adding free weights to the handheld elements, the center of gravity of each of the handheld elements is moved toward the free weights 90. Accordingly, when the handheld elements 82, 84 are held in a person's hands, the free weights 90 act to turn the handheld elements in the directions of arrow 91 and arrow 92, respectively. The bias toward rotation created by the free weights 90 is the biasing mechanism that acts against the alignment of the first handheld element 82 with the second handheld element 84.

It will therefore be understood that many different biasing mechanisms can be adapted for use with the present invention. In each usable biasing mechanism, there is some mechanism that can provide a bias that opposes the linear orientation of the two halves of the exercise device. Such mechanisms can include tension elements like elastic cords and springs, such as is shown in FIG. 1. Biasing mechanisms can also include opposing magnets, such as are shown in FIG. 4. Biasing mechanisms can also include unbalanced handheld elements, such as is shown in FIG. 5. Other biasing elements can be physical obstructions, such as springs or elastomeric structures that are placed between the two halves of the exercise device. Accordingly, to linear align the two halves of the exercise device, the springs or elastomeric structures must be compressed between the two halves.

It will be understood that the embodiments of the present invention device described and illustrated are merely exemplary and a person skilled in the art can make many variations to the shown embodiment. All such alternate embodiments and modifications are intended to be included within the scope of the present invention as defined below in the claims.

What is claimed is:

1. An exercise device, comprising:

a first handheld element having a first surface thereon;

a second handheld element having a second opposing surface thereon;

at least one elastic element coupled to both said first handheld element and said second handheld element, wherein said elastic element is stretched when said first surface is aligned with said second opposing surface and applies a force that opposes the alignment of said first surface with said second opposing surface.

2. The device according to claim 1, wherein said first handheld element and said second handheld element each weigh between two pounds and twenty five pounds.

3. The device according to claim 1, wherein said first handheld element is symmetrically disposed around a first linear axis and said second handheld element is symmetrically disposed around a second linear axis, wherein said first linear axis and said second linear axis are aligned when said first surface is aligned with said second opposing surface.

4. The device according to claim 1, further including an alignment mechanism that indicates when said first surface is aligned with said second opposing surface.

5. The device according to claim 4, wherein said alignment mechanism includes mechanical structures on said first surface and said second opposing surface that interconnect when said first surface and said second opposing surface are aligned and biased against each other.

6. The device according to claim 4, wherein said alignment mechanism includes a light source disposed in said first handheld element and a light detector disposed in said second handheld element, wherein said light detector detects light from said light source when said first surface is aligned with said second opposing surface.

7. The device according to claim 1, wherein said first handheld element is elongated having said first surface at one end and said elastic element engaging said first handheld element at a point proximate an end opposite said first surface.

8. The device according to claim 7, wherein said second handheld element is elongated having said second opposing surface at one end and said elastic element engaging said second handheld element at a point proximate an end opposite said second opposing surface.

9. The device according to claim 1, wherein said elastic element is selected from a group consisting of elastic cords and springs.

10. An exercise device, comprising:

a first handheld element having a first handle section thereon, wherein said first handle element has a first center of gravity;

a second handheld element having a second handle section thereon, wherein said second handle element has a second center of gravity; and magnets disposed in said first handheld element and said second handheld element that repel each other when said first surface is brought into close proximity with said second opposing surface, wherein said magnets oppose the positioning of said first handheld element and said second handheld element in a predetermined orientation.

11. The device according to claim 10, wherein said magnets apply a force to said first handheld element and said second handheld element that cause said first handheld element and said second handheld element to rotate about said first center of gravity and said second center of gravity respectively, when said first handheld element and said second handheld element are in said predetermined orientation.

12. The device according to claim 10, further including an alignment mechanism that indicates when said first handheld element and said second handheld element are in said predetermined orientation.

13. A method of exercising comprising the steps of:

providing a first handheld element;

providing a second handheld element;

providing an elastic element that extends between said first handheld element and said second handheld element, wherein said elastic element provides a force that acts to oppose the positioning of said first handheld element and said second handheld element in a predetermined orientation;

holding said first handheld object in one hand;

holding said second handheld object in the other hand; and manually orienting said first handheld element and said second handheld element into said predetermined orientation.

14. The method according to claim 13, further including the step of providing an alignment mechanism that provides an indication of when said first handheld element and said second handheld element are in said predetermined orientation.

* * * * *